US007077632B2

(12) United States Patent
Osburg et al.

(10) Patent No.: US 7,077,632 B2
(45) Date of Patent: Jul. 18, 2006

(54) BLOWER HAVING A BLOWER TUBE INCORPORATING A REDUCTION DEVICE FOR REDUCING THE CLEAR FLOW CROSS SECTION OF SAID BLOWER TUBE AT IDLE OPERATION

(75) Inventors: Gerhard Osburg, Kernen (DE); Wolfgang Luithardt, Waiblingen (DE); Peter Schmidt, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/703,514

(22) Filed: Nov. 10, 2003

(65) Prior Publication Data

US 2004/0096342 A1 May 20, 2004

(30) Foreign Application Priority Data

Nov. 14, 2002 (DE) ..... 102 52 942

(51) Int. Cl.
*F04B 35/00* (2006.01)

(52) U.S. Cl. ..... 417/364; 417/326; 415/148; 415/208.1; 239/507; 239/509

(58) Field of Classification Search ..... 417/326, 417/364; 415/148, 208.1; 239/507, 509, 239/512, 152, 129, 154; 15/328, 329, 330, 15/344, 405

See application file for complete search history.

(56) References Cited

U.S. PATENT DOCUMENTS

| | | | | | |
|---|---|---|---|---|---|
| 2,139,090 | A | * | 12/1938 | Alf et al. | 123/324 |
| 2,311,936 | A | * | 2/1943 | Elfes et al. | 123/564 |
| 3,147,767 | A | * | 9/1964 | Goss | 137/879 |
| 3,827,827 | A | * | 8/1974 | Hill | 417/28 |
| 3,876,336 | A | * | 4/1975 | Nash | 417/38 |
| 4,047,665 | A | * | 9/1977 | Moynihan | 239/124 |
| 4,097,722 | A | * | 6/1978 | Soler et al. | 392/385 |
| 4,238,073 | A | * | 12/1980 | Liska | 239/127 |
| 4,505,169 | A | * | 3/1985 | Ganoung | 477/100 |
| RE32,030 | E | * | 11/1985 | Yano et al. | 701/102 |
| 4,714,864 | A | * | 12/1987 | Yogo et al. | 318/52 |
| 4,872,434 | A | * | 10/1989 | Sekiyama | 123/320 |
| 4,882,906 | A | * | 11/1989 | Sekiyama et al. | 60/624 |
| 5,152,360 | A | * | 10/1992 | Haefner et al. | 180/197 |
| 6,116,864 | A | * | 9/2000 | Veser et al. | 417/364 |
| 6,148,743 | A | * | 11/2000 | Vatsky | 110/297 |
| 6,158,152 | A | * | 12/2000 | Nathenson et al. | 37/347 |
| 6,468,053 | B1 | | 10/2002 | Wölpert | |
| 6,575,695 | B1 | * | 6/2003 | Miyamoto | 415/119 |
| 6,640,384 | B1 | * | 11/2003 | Sanders et al. | 15/330 |
| 6,676,462 | B1 | * | 1/2004 | Yanagihara | 440/4 |
| 2004/0129252 | A1 | * | 7/2004 | Wayama et al. | 123/399 |

* cited by examiner

*Primary Examiner*—Charles G. Freay
*Assistant Examiner*—Emmanuel Sayoc
(74) *Attorney, Agent, or Firm*—Walter Ottesen

(57) ABSTRACT

A blower (1) has a housing (10) to which a blower pipe (2) may be removably connected. An internal combustion engine located within the housing (10) drives a blower wheel. The blower wheel, in turn, generates an air flow (11) within the blower pipe. To reduce the exhaust gases and the fuel consumption during idle operation of the combustion engine, a reduction device (12, 22), located in the blower pipe downstream of the blower wheel reduces the clear cross section of flow during idle operation of the engine.

14 Claims, 2 Drawing Sheets

BLOWER HAVING A BLOWER TUBE INCORPORATING A REDUCTION DEVICE FOR REDUCING THE CLEAR FLOW CROSS SECTION OF SAID BLOWER TUBE AT IDLE OPERATION

CROSS REFERENCE TO RELATED APPLICATION

This application claims priority of German patent application no. 102 52 942.6, filed Nov. 14, 2002, the entire content of which is incorporated herein by reference.

FIELD OF THE INVENTION

The invention relates to a blower having a housing and a blower pipe connected to the housing. An internal combustion engine is mounted in the housing and drives a blower wheel which generates an air flow in the blower pipe.

BACKGROUND OF THE INVENTION

U.S. Pat. No. 6,468,053 describes a blower having a housing wherein an internal combustion engine is mounted. The internal combustion engine drives a blower wheel, which generates a stream of air in a blower pipe.

Generally, blowers are not equipped with couplings. Accordingly, when the internal combustion engine is running at idle, the blower wheel continues to be powered. Consequently, there is also a stream of air in the blower pipe when the engine is at idle, and this, in turn, can raise dust and dirt. The output during idle operation is also relatively high, which results in high fuel consumption during idle.

SUMMARY OF THE INVENTION

It is an object of this invention to provide a blower of the above kind which achieves a reduction of the exhaust gases of the blower in a simple manner.

According to one aspect, the present invention is directed to a blower including a blower pipe removably connected to a housing, an internal combustion engine located within the housing and a blower wheel driven by the engine. The blower wheel generates an air flow within the blower pipe. Also located within the blower pipe is a reduction device, which is located downstream of the blower wheel and which reduces the free or clear cross section of air flow during idle operation of the combustion engine.

The reduction of the free cross section of air flow during idle operation results in a reduction of engine power required to move the air flow. This results initially in an increase in the number of revolutions. However, this idle rpm can then be reduced, resulting in a reduction of fuel consumption. At the same time, the reduction of the free cross section of air flow prevents the raising of dust and dirt. In a preferred embodiment of the present invention, the cross section of air flow is substantially closed during idle operation.

In one embodiment of the invention, the device to reduce the cross section of air flow (hereinafter "reduction device") is driven by a mechanical actuating element. In a preferred embodiment, the position of the reduction device is coupled to the position of the throttle lever. This ensures that the reduction device only reduces the free cross section of air flow during idle operation. In an alternative preferred embodiment, the reduction device is controlled by a spring. In one preferred embodiment, the reduction device is located in the blower pipe. In another preferred embodiment, the reduction device is located in the area of the blower wheel. Such a reduction device, if appropriately designed, can also protect against injuries at the intake opening.

In a preferred embodiment of the invention, the reduction device comprises at least one throttle flap. In a preferred configuration of this embodiment, the throttle flap is journalled eccentrically and is spring biased in the direction of the closed position. In this configuration, a spring acts against the buildup of dynamic pressure which results from the flow of air. With an appropriate configuration of the spring, it can be achieved that the throttle flap opens at a certain dynamic pressure, that is, from a certain number of revolutions of the engine onwards. Accordingly, it can be guaranteed that, when the number of revolutions of the engine decreases, starting from a specific number of revolutions, that is, starting from a certain amount of delivered air flow, the dynamic pressure will be insufficient to keep the throttle flap open, resulting in its closure due to the power of the spring. A configuration consisting essentially of a throttle flap and a spring is easy to produce and requires few parts. At the same time, proper functioning can be ensured.

In a preferred embodiment, the throttle flap is, in its open position, arranged parallel to the air flow, thus affecting the air flow as little as possible during full load. However, in certain embodiments of the invention, it is practical that the open position of the throttle flap of the reduction device is adjustable. In such an embodiment, if the reduction device is appropriately positioned, the cross section of air flow can be reduced also at full load and thus a nozzle function can be achieved. Accordingly, with the appropriate configuration of the reduction device, nozzle attachments on the blower pipe can be omitted.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
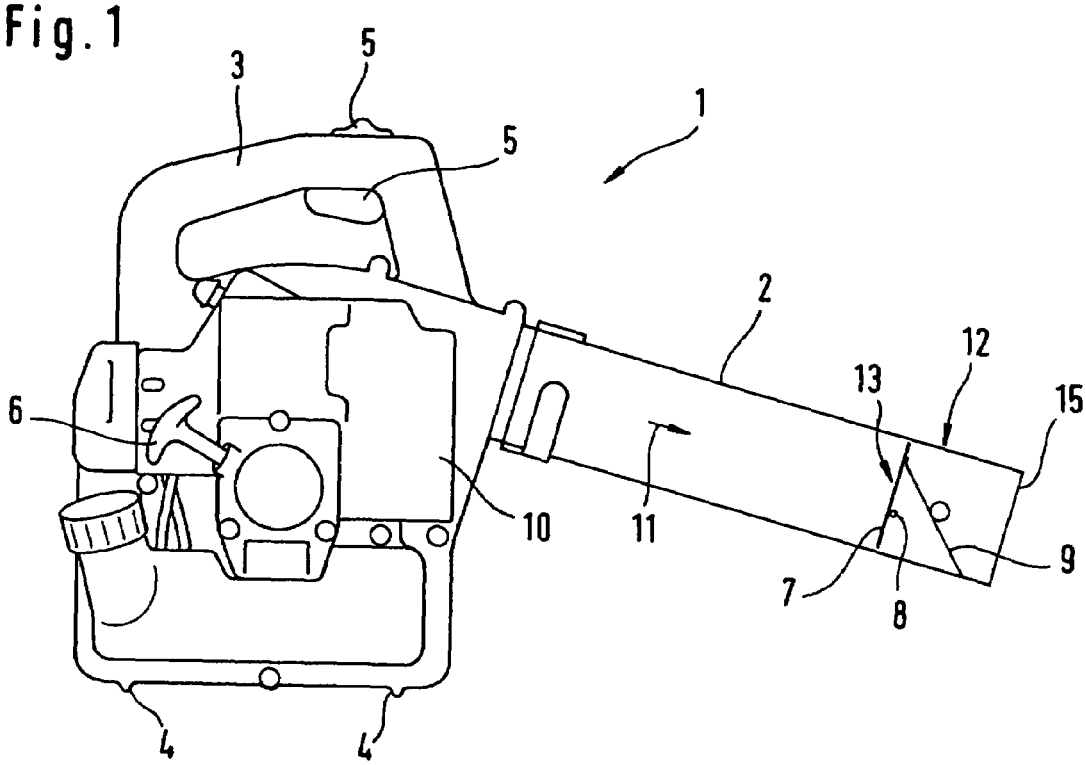
FIG. 1 is a schematic of a blower with a reduction device during idle operation of the internal combustion engine.

The blower (1) shown in FIG. 1 has a housing (10) with an attached blower pipe (2). Also attached to the blower are a handle (3) and feet (4) to set the blower (1) down. Operator-controlled levers (5) are situated in the handle area (3) of the blower (1). A starter handle (6) to pull start the engine projects from the housing (10). The engine drives a blower wheel, which generates an air flow through the blower pipe (2).

A reduction device (12) is located in the blower pipe (2) in the area of the discharge opening (15) and comprises a throttle flap (7) which is journalled eccentrically around the rotation axis (8). In the closed position (13) shown in FIG. 1, the throttle flap (7) substantially closes the cross section of the blower pipe (2). As a result, the air flow is minimal in the closed position (13). A spring (9) resiliently biases the throttle flap (7) into the closed position (13). The spring (9)

is positioned downstream of the throttle flap (7) and is supported at one end by the blower pipe (2) and at the other end by the throttle flap (7).

Figure 2:
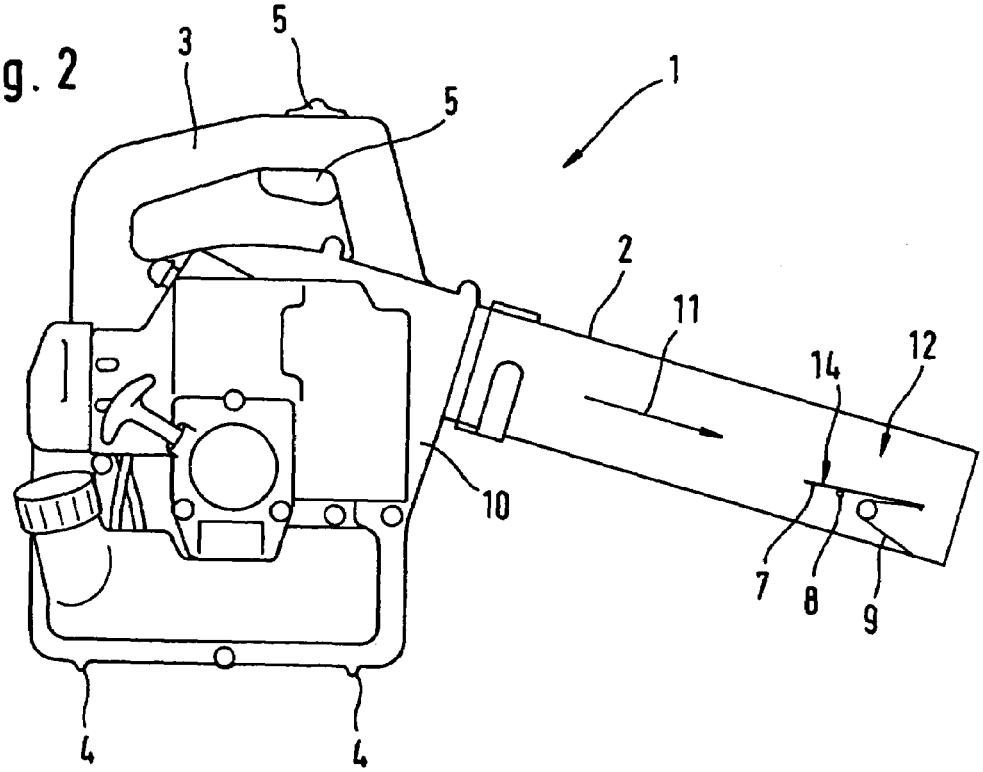
FIG. 2 is a schematic of a blower with a reduction device during full-load operation of the engine.

FIG. 2 shows the blower (1) when the number of revolutions of the engine is high. The reduction device (12) hardly hinders the air flow (11) since the throttle valve is in its open position (14), that is, is positioned substantially parallel to the air flow (11) in the blower pipe.

During fullload operation of the combustion engine as shown in FIG. 2, the blower wheel is driven at a high number of revolutions. The resulting air flow exerts an extensive dynamic pressure on the throttle flap (7). This dynamic pressure exceeds the force applied by the spring (9) on the throttle flap (7) with the result that the throttle flap (7) assumes a position approximately parallel to the air flow (11) in the blower pipe (2). The eccentric journalling of the throttle flap (7) ensures an opening.

When the force applied by dynamic pressure on the throttle flap (7) drops below the force exerted by the spring (9) on the throttle flap, the throttle flap (7) rotates about the axis (8) to assume the closed position shown in FIG. 1. Accordingly, the delivered air flow (11) is greatly reduced. Due to the lowered output, the number of revolutions (rpm) of the engine initially increases. However, the rpm can be reduced to a low value resulting in a reduction of the fuel consumption of the blower (1) at idle.

In certain embodiments, it can be practical to locate the reduction device close to the blower wheel. In other embodiments, the reduction device is not controlled by the dynamic pressure but exclusively via a spring or a mechanical actuating element. In a preferred embodiment, the position of the reduction device (12) is coupled to the position of the throttle lever (5). In order to achieve a nozzle effect with the reduction device (12), in particular with the throttle flap (7), the throttle flap (7) is in the open position (14), not parallel to, but slightly tilted relative to the air flow (11) to reduce the free cross section of flow.

In a preferred embodiment, the reduction of the free cross section of flow in the open position of the reduction device (12) can be adjusted by the operator, thus allowing the operator to achieve with a single blower pipe (2) the function of different nozzle attachments. To keep the return forces of the spring (9) on the throttle flap (7) low during the increase of the rpm from idle, the spring is, in certain embodiments, designed digressively. In other embodiments, there are two throttle flaps instead of one throttle flap (7), each of which has the shape of a half circle and is positioned on one side of the blower pipe. In a preferred embodiment, the two throttle flaps are journalled on an axis in the center of the blower pipe and are resiliently biased in the direction of the closed position. However, as the person skilled in the art will appreciate, the present invention includes other positions of the throttle flap which might be advantageous in certain embodiments of the invention.

Figure 3:
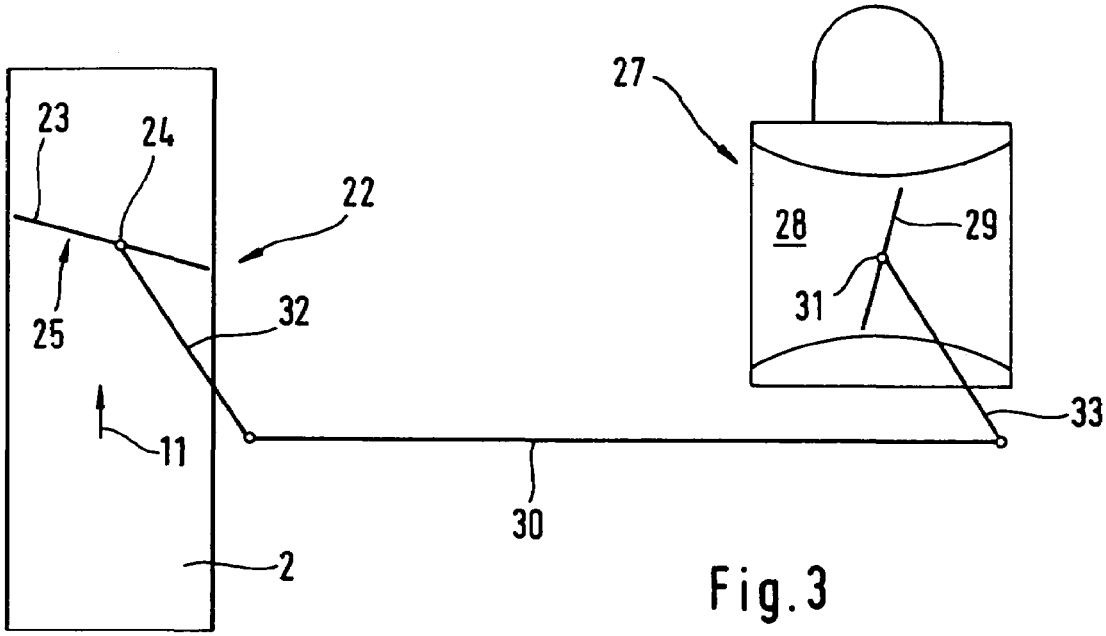
FIG. 3 is a schematic of a blower with a reduction device during idle operation of the internal combustion engine; and, FIG. 4 is a schematic of a reduction device during full-load operation of the engine.
Figure 4:
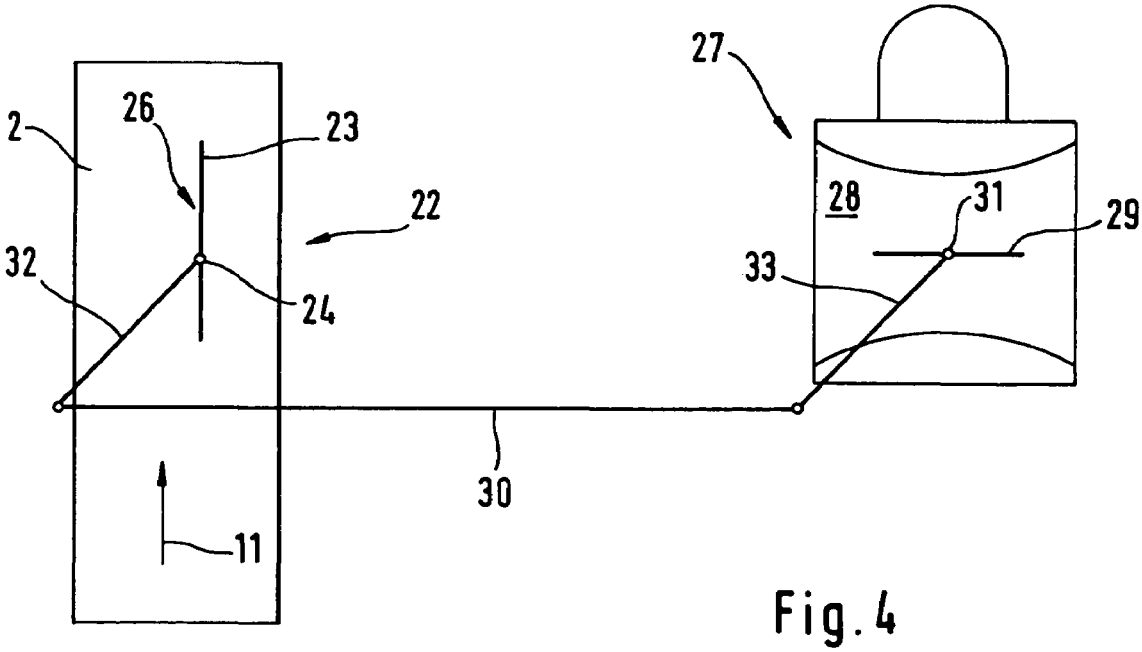

FIGS. 3 and 4 are schematics of examples of reduction devices (22). The reduction device (22) includes a throttle flap (23), which is located within a blower pipe (2) and is pivotally journalled about a rotation axis (24). The rotation axis (24) is positioned eccentrically in the blower pipe (2). It can, however, be practical to arrange the rotation axis (24) centered in the blower pipe (2). The throttle flap (23) is coupled to the throttle flap (29) of a carburetor (27) via a coupling (30). In one embodiment, the coupling (30) takes the form of a coupling rod, which connects a first lever (32) to a second lever (33). The first lever (32) is connected to the throttle flap (23) of the reduction device (22) so that the throttle flap (23) and the first lever (32) rotate conjointly. The second lever (33) is connected to the throttle flap (29) of the carburetor (27) so that the second lever (33) and the throttle flap (29) rotate conjointly. The throttle flap (29) of the carburetor is pivotally journalled about a rotation axis (31) in a portion (28) of an intake channel within the carburetor (27).

For the idle position shown in FIG. 3, the throttle flap (29) substantially closes the intake channel section (28). The throttle flap (23) in the blower pipe is coupled to the throttle flap (29) and is in a closed position (25) and substantially closes the blower pipe (2), so that the air flow, which is moved through the blower pipe (2) and which is indicated by the arrow (11), is small.

During acceleration via the operator-controlled lever (5) shown in FIGS. 1 and 2, the throttle flap (29) opens. In FIG. 4, the throttle flap (29) is approximately parallel to the longitudinal axis of the section of the intake channel (28) and is in its full-load position. The throttle flap (23) in the blower pipe (2) is pivoted via coupling (30) about the axis (24) and is in the open position (26), in which the throttle flap (23) is approximately parallel to the air flow in the blower pipe (2) indicated by the arrow (11). Thus, during full-load operation, the air flow in the blower pipe (2) is hardly affected by the reduction device (22).

In the embodiments shown in FIGS. 3 and 4, the reduction device is coupled to the position of the throttle lever via the throttle flap (29). However, as the person in the art will readily appreciate, other couplings are within the scope of the present invention. For example, in certain embodiments, the coupling can be a direct coupling between the throttle lever and the reduction device (22).

It is understood that the foregoing description is that of the preferred embodiments of the invention and that various changes and modifications may be made thereto without departing from the spirit and scope of the invention as defined in the appended claims.

What is claimed is:

1. A blower comprising:

a housing;

a single blower pipe connected to said housing;

an internal combustion engine for providing an adjustable power output and said engine being located within said housing;

a blower wheel driven by said engine for generating a blower air flow wherein all of said blower airflow passes through said single blower pipe;

a reduction device mounted in said air flow downstream of said blower wheel for changing the clear flow cross section of said blower pipe in dependence upon the adjusted power output of said engine;

a mechanical actuating element; and, said mechanical actuating element being operatively connected to said reduction device for controlling the latter; and, said mechanical actuating element being a throttle lever for adjusting the power output of said internal combustion engine having a position coupled to the position of said reduction device so as to reduce said clear flow cross section during idle operation of said engine and thereby reducing the engine power required to move the air flow; and that during full load operation, said reduction device being in its open position.

2. The blower of claim 1, wherein said reduction device is located within said blower pipe.

3. The blower of claim 1, wherein said reduction device is positioned close to said blower wheel.

4. The blower of claim 1, wherein said reduction device comprises at least one throttle flap.

5. The blower of claim 4, wherein said throttle flap is, when in an open position, substantially parallel to said air flow.

6. The blower of claim 1, wherein said reduction device has an open position which can be adapted.

7. A blower comprising:

a housing;

a single blower pipe connected to said housing;

an internal combustion engine for providing an adjustable power output and said engine being located within said housing;

a blower wheel driven by said engine for generating an air flow in said blower pipe;

a reduction device mounted in said air flow downstream of said blower wheel for changing the clear flow cross section of said blower pipe in dependence upon the adjusted power output of said engine so as to reduce said clear flow cross section during idle operation of said engine;

said reduction device including a throttle flap pivotally mounted and eccentrically journalled in said air flow downstream of said blower wheel; and, resilient biasing means for applying a resilient biasing force to said throttle flap sufficient to overcome the force of said air flow when said engine is in said idle operation to thereby automatically effect a reduction of said clear flow cross section at said idle operation and thereby reducing the engine power required to move the air flow, said eccentrically journalled throttle flap and resilient biasing means being adapted in a way, that during full load operation, as a result of the dynamic pressure of the air flow applied to the throttle flap, said flap is in its open position.

8. The blower of claim 7, wherein said reduction device is controlled by a spring.

9. The blower of claim 7, wherein said reduction device is located within said blower pipe.

10. The blower of claim 7, wherein said reduction device is positioned close to said blower wheel.

11. The blower of claim 7, wherein said reduction device comprises at least one throttle flap.

12. The blower of claim 11, wherein said at least one throttle flap is journalled eccentrically and is resiliently biased towards the closed position.

13. The blower of claim 11, wherein said throttle flap is, when in an open position, substantially parallel to said air flow.

14. The blower of claim 7, wherein said reduction device has an open position which can be adapted.

* * * * *